US008740345B2

(12) United States Patent
Masuda

(10) Patent No.: US 8,740,345 B2
(45) Date of Patent: Jun. 3, 2014

(54) PRINTING APPARATUS

(75) Inventor: Shuichi Masuda, Yokohama (JP)

(73) Assignee: Canon Kabushiki Kaisha, Toyko (JP)

( * ) Notice: Subject to any disclaimer, the term of this patent is extended or adjusted under 35 U.S.C. 154(b) by 142 days.

(21) Appl. No.: 13/529,225

(22) Filed: Jun. 21, 2012

(65) Prior Publication Data

US 2013/0002749 A1 Jan. 3, 2013

(30) Foreign Application Priority Data

Jun. 28, 2011 (JP) ..... 2011-142930

(51) Int. Cl.
*B41J 2/165* (2006.01)

(52) U.S. Cl.
USPC ..... 347/30

(58) Field of Classification Search
USPC ..... 347/19, 22, 23, 29–30
See application file for complete search history.

(56) References Cited

U.S. PATENT DOCUMENTS 7,396,112 B2 * 7/2008 Sanada ..... 347/68
8,336,985 B2 * 12/2012 Hokazono et al. ..... 347/19

FOREIGN PATENT DOCUMENTS

JP 2009-78571 A 4/2009

* cited by examiner

*Primary Examiner* — Lamson Nguyen
(74) *Attorney, Agent, or Firm* — Fitzpatrick, Cella, Harper & Scinto

(57) ABSTRACT

A printing apparatus is provided that can appropriately suction and hold a print medium on a platen by employing suction in accordance with the properties of different types of print media. In the printing apparatus, grooves are formed in the support face of the platen on which the print medium is held, and are extended in a conveying direction in which the print medium is to be conveyed. Groove suction holes are formed inside the grooves to apply suction. Rib suction holes are formed in the support face of the platen. The printing apparatus employs at least either the stiffness of the print medium or the print duty to control a ratio between the amount of suction applied via the groove suction holes and the amount of suction applied via the rib suction holes.

13 Claims, 12 Drawing Sheets

PRINTING APPARATUS

BACKGROUND OF THE INVENTION

1. Field of the Invention

The present invention relates to a printing apparatus that employs suction to hold a print medium on a platen and performs printing.

2. Description of the Related Art

For printers, copiers, facsimile machines, scanners and multifunctional machines and systems, printing apparatuses, for which print heads are provided, are employed that, based on image data, print images on print media such as printing sheets. One commonly used apparatus of this type is an ink jet printing apparatus, which prints images on print media by ejecting ink, through ejection ports in a print head, onto the print media.

In an ink jet printing apparatus, suppressing deformation (also called cockling) of a print medium, such as wrinkling or the formation of wavy edges, that occurs when ink is applied, is required for performing printing in stable. Also, in the print medium, suppressing occurring deformation such as a curling is required. It is because the print medium may touch a print head or a carriage and cause the quality of a printed image to be deteriorated, when a print medium on a platen is deformed.

For example, a method for maintaining a constant distance between a print medium and a print head is proposed in Japanese Patent Laid-Open No. 2009-78571. According to this proposal, suction means is provided for a platen located opposite a print head, and suction is applied to hold a print medium on the platen. According to a printing apparatus described in Japanese Patent Laid-Open No. 2009-78571, printing can be performed while print medium deformation, such as curling or cockling, is suppressed. As the suction means provided for holding a print medium, grooves are formed, in a conveying direction, in a platen whereon a print medium is supported, and suction hole arrangements are prepared in the grooves, so that in use, a negative pressure is applied to the print medium, via the suction holes, so as to hold the print medium on the platen. Further, even when cockling has occurred in the print medium, since the grooves are formed in the platen, the cockled portions of a print medium will enter the grooves. With this arrangement, variations in distance between the print head and the print medium, due to deformation of the print medium by cockling, can be suppressed.

Furthermore, according to the printing apparatus disclosed in Japanese Patent Laid-Open No. 2009-78571, grooves are located between a set of two adjacent ribs, and two types of ribs are provided, comparatively low and comparatively high. Since the printing apparatus is arranged in this manner, when a print medium having relatively low stiffness, i.e., a print medium having low flexural rigidity and high flexibility, is held on a platen by suction, printing can be performed while the print medium is arranged along the grooves. On the other hand, when a print medium having relatively high stiffness, printing can be performed while the print medium is supported on the ribs. Therefore, different types of print media, for which the degree of stiffness varies, can be conveyed while being held on the platen by suction.

However, in the printing apparatus disclosed in Japanese Patent Laid-Open No. 2009-78571, since a print medium is suctioned from the entire area of a platen evenly, in a case that the cockled condition of the print medium is partially changed, there is possibility that the apparatus may not cope appropriately. When printing is performed with a high print duty, there is possibility that the cockling becomes greater by increasing the amount of ink provided for a unit print area. When suction is performed with a high suction pressure to hold a print medium for which larger-scale cockling has even occurred by high-duty printing, on the platen appropriately, it is difficult for a print medium for which printing is performed at a low print duty to be appropriately held on the platen. For printing performed at a low print duty, such as printing of line art, there is a case wherein the scale of cockling is small. Especially, in a case wherein printing at a low print duty is performed for a print medium, such as plain paper having a comparatively low stiffness, or proofing paper, due to suction through suction holes, a part of the print medium might move into a gap between the ribs, even though no cockling of the print medium has occurred. Accordingly, there is a possibility that a print medium will be arranged on a platen in the wavy condition. In this case, the distance between the print medium and the print head varies, depending on the positioning, so that deviations may occur in the landing positions of ink droplets ejected by the print head, and an unevenness may occur in the printing of regular lines, such as hatching.

Furthermore, there is an idea that the suction pressure applied through the suction holes should be reduced in order to avoid printing unevenness. However, when the suction pressure is merely reduced, deformation of a print medium caused by curling or cockling can not be suppressed, and the quality of a printed image may be degraded.

SUMMARY OF THE INVENTION

Accordingly, taking into account the above considerations, an object of the present invention is to provide an ink jet printing apparatus that, in accordance with the properties of different types of print media and the states of images to be printed, can apply suction to appropriately hold a print medium on a platen.

According to an aspect of the present invention, there is provided a printing apparatus, which includes a print head capable of ejecting ink, and which ejects ink from the print head onto a print medium conveyed along a support face of a platen, on which the print medium is supported, comprising: grooves, formed in the support face of the platen for supporting the print medium and extended in a conveying direction in which the print medium is conveyed; first suction portions, formed inside the grooves to perform suction; a first suction unit for suctioning air from the first suction portions; second suction portions formed in the support face of the platen; a second suction unit for suctioning air from the second suction portions; and a control unit being able to control a ratio of an amount of suction provided by the first suction unit and an amount of suction provided by the second suction unit, based on at least either a stiffness of a print medium or a print duty.

According to an aspect of the present invention, there is provided a printing apparatus comprising: a print head for ejecting ink; a platen having a support face in which grooves are formed and on which a print medium is supported; suction portions formed in the grooves; and a control unit for controlling a suction force, applied through the suction portions, changing corresponding to at least one of a stiffness of the print medium and an amount of ink to be applied.

According to the present invention, since different ways in which suction is applied are employed to hold a print medium in a printing position, a print medium can be appropriately held on a platen by applying a suction force that is appropriate for the property of the print medium and the state of an image to be printed.

Further features of the present invention will become apparent from the following description of exemplary embodiments (with reference to the attached drawings).

DESCRIPTION OF THE EMBODIMENTS

The preferred embodiments of the present invention will now be described while referring to accompanying drawings.

First Embodiment

Figure 1:
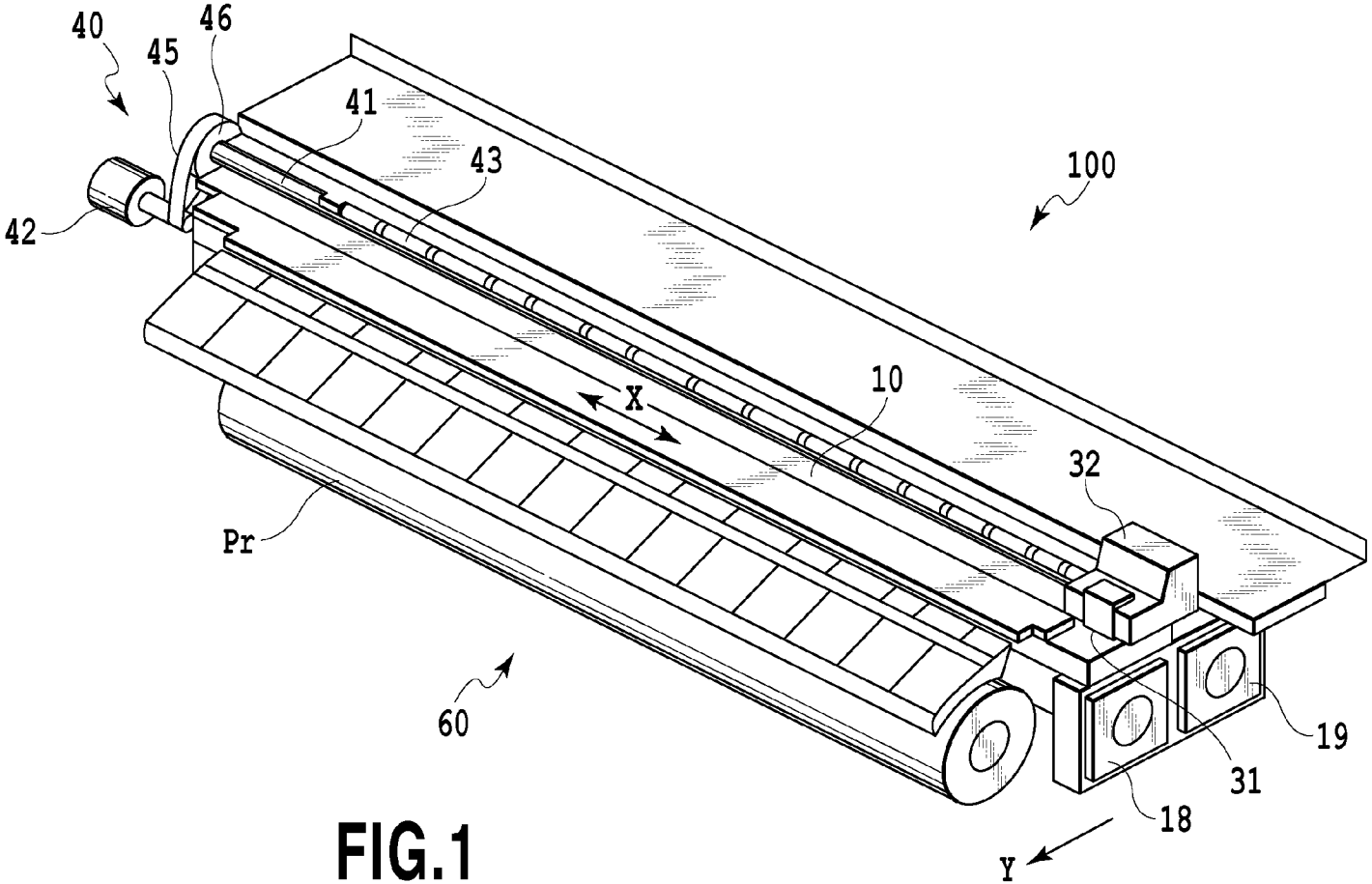
FIG. 1 is a schematic perspective view of the essential portion of a printing apparatus according to a first embodiment of the present invention.
Figure 2:
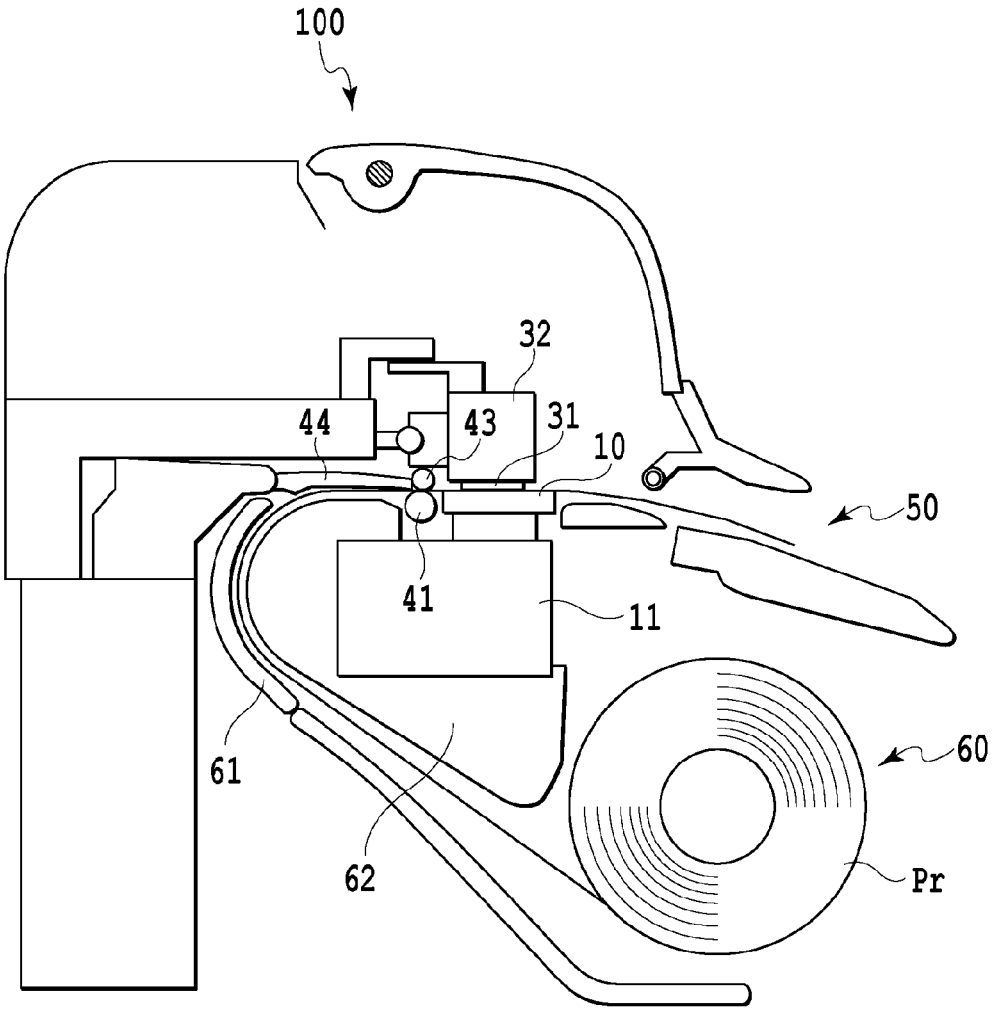
FIG. 2 is a schematic cross-sectional view of the essential portion of the printing apparatus in FIG. 1, showing a state wherein a chassis is attached.

FIG. 1 is a perspective view of a printing apparatus 100 according to a first embodiment of the present invention. FIG. 2 is a cross-sectional view of the state of the printing apparatus 100 of the first embodiment wherein a chassis is attached. As shown in FIGS. 1 and 2, the printing apparatus 100 is an ink jet printing apparatus that, to perform printing, ejects ink onto a print medium via a print head 31. In this embodiment, paper Pr, formed into a roll (rolled paper Pr), is employed as a print medium.

A conveying mechanism 40, which includes a conveying roller 41, is arranged in the printing apparatus 100, and the rolled paper Pr is set up so as to be rotatable about a rotary shaft. Then, the leading portion of the rolled paper Pr is fed out when rotation of the rolled paper Pr is performed. The leading portion of the rolled paper Pr is guided between a lower paper conveyance guide 61 and an upper paper conveyance guide 62, and passes the location of a nip portion, formed by the conveying roller 41 and a pinch roller 43. The leading portion of the rolled paper Pr passes a printing position opposed to the print head 31, and reaches a discharge paper portion. A part of rolled paper Pr is clamped at the nip portion formed by the conveying roller 41 and the pinch roller 43. In this condition, when the conveying roller 41 is driven and rotated, the rolled paper Pr is conveyed and supplied continuously from a rolled paper feed unit 60 in a conveying direction Y. A conveying pulley 46 is provided to an axis of the conveying roller 41. When a conveying motor 42 is driven and rotates, the rotation is transmitted to the conveying pulley 46 via a conveying belt 45, as a result, the conveying roller 41 is driven and rotates. The pinch roller 43 is axially supported by a pinch roller arm 44 so that the pinch roller 43 is rotatable. The pinch roller 43 is supported with being urged in a direction that the pinch roller 43 contacts to and pushes the conveying roller 41.

On the downstream side of the conveying roller 41 in the conveying direction Y, a platen 10, on which a print medium can be supported, is arranged opposite the print head 31. A carriage 32, on which the print head 31 is mounted, is arranged to be reciprocated in the main scan direction X, which intersects the conveying direction Y for the print medium. Especially in this embodiment, the main scan direction X of the carriage 32 is perpendicular to the conveying direction Y for the print medium, the carriage 32 is reciprocated, in the main scan direction X, by a driving of a main scan motor. The print head 31 has an ejection port face, opposite a print medium, in which a plurality of ejection ports are arranged, at predetermined pitches, to form an ejection port array. To enable color printing, a plurality of such ejection port arrays, corresponding to each of individual colors, are provided for the print head 31. The print head 31 is formed so that the print head 31 can eject ink through the ejection ports. Based on image data, the print head 31 ejects ink onto a print medium, and print image thereon. Then, the rolled paper Pr in which printing has been performed is cut by a cutter (not shown). A portion of rolled paper Pr cut is discharged from a discharge unit 50 to the outside of the apparatus.

The arrangement for the periphery of the platen 10 in this embodiment will now be described.

Figure 3:
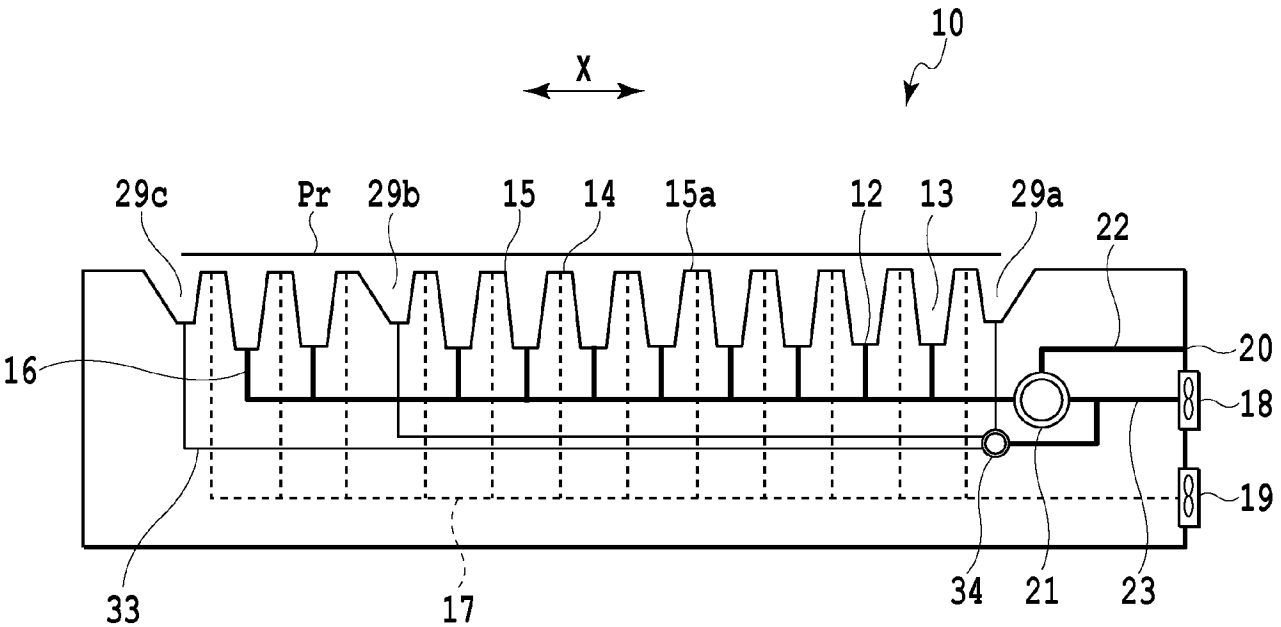
FIG. 3 is schematic cross-sectional view of the arrangement of the printing apparatus in FIG. 1 for the periphery of a platen and flow paths employed for performing suction.
Figure 4:
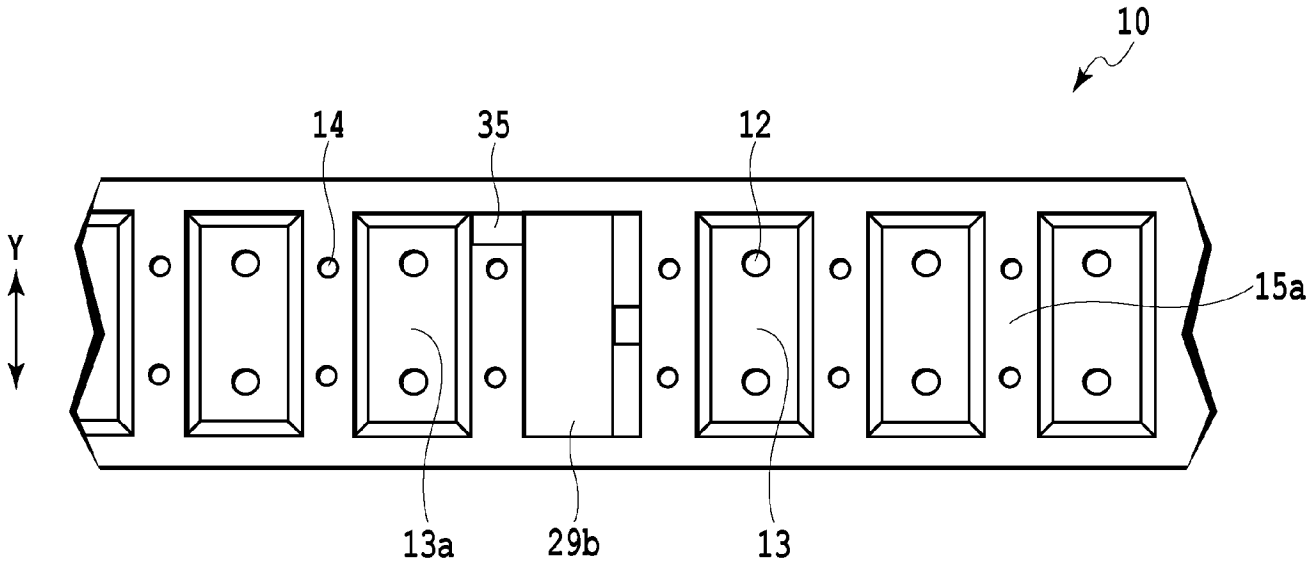
FIG. 4 is a schematic plan view of the platen in FIG. 3 when viewed from a print head.
Figure 5A:
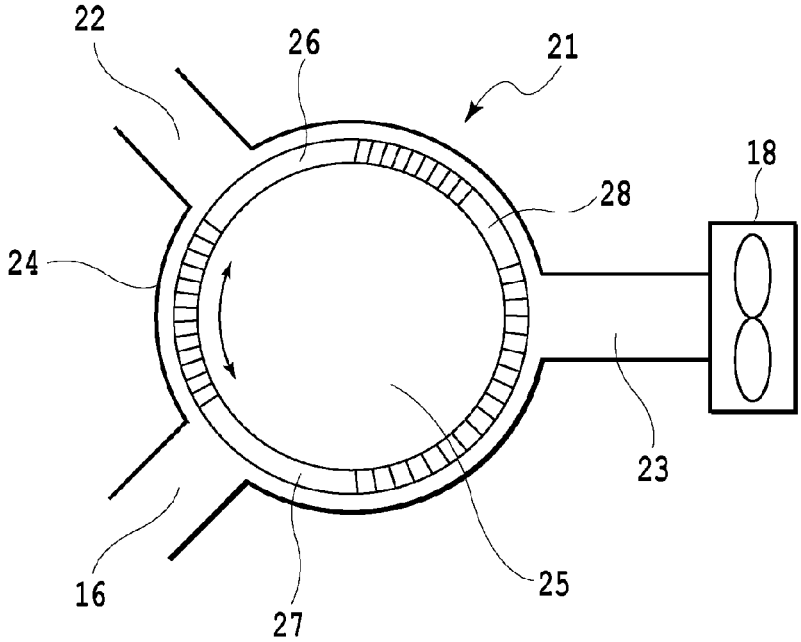
FIGS. 5A and 5B are enlarged, schematic cross-sectional views of the individual states for a groove suction shutter in FIG. 3.
Figure 5B:
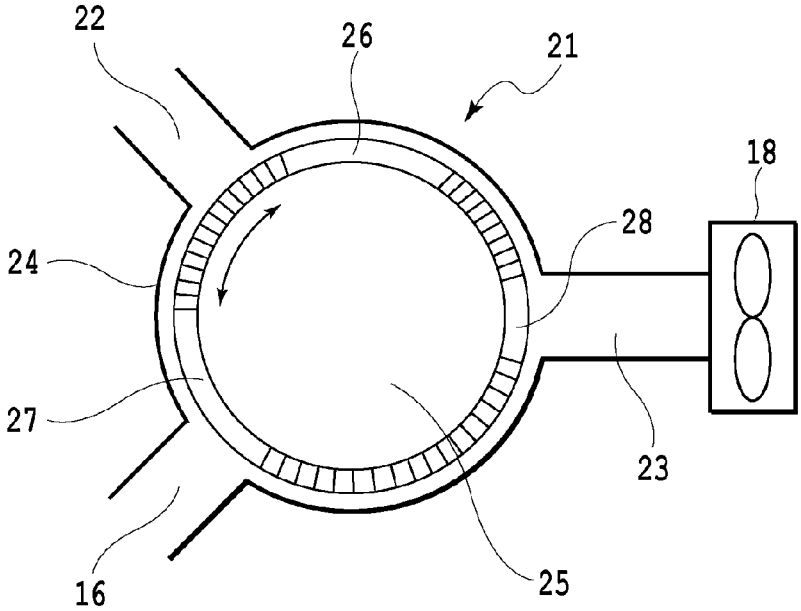

FIG. 3 is a cross-sectional view of the platen suction structure that includes suction ducts and a negative pressure generation portion. FIG. 4 is a plan view of the upper face of the platen 10. FIGS. 5A and 5B are schematic diagrams of a negative pressure switching portion (shutter) provided for each suction duct.

The platen 10 supports a print medium at a position opposite the print head 31. In this embodiment, the platen 10 guides and supports the print medium at a position a predetermined distance from the ejection port face of the print head 31. A plurality of suction holes are formed in the platen 10, and by applying negative suction pressure through the suction holes, the print medium is suctioned and held on the platen 10. In this embodiment, the platen 10 is located above a chassis 11.

A plurality of grooves 13 are formed in the platen 10, and are extended in the conveying direction Y for a print medium. The grooves 13 are arranged parallel to each other in the main scan direction X. Between the grooves 13, a plurality of ribs 15 are formed along the main scan direction X. The ribs 15 are extended in the conveying direction Y between the grooves 13. In the grooves 13, groove suction holes (first suction portions) 12 are formed, through which air is to be drawn in to suction and hold the print medium on the platen 10. In this embodiment, two groove suction holes 12 are formed for one groove 13. In the platen 10, the groove suction holes 12 and rib suction holes 14, which will be described later, are alternately arranged. Furthermore, a groove suction duct (suction duct) 16 is formed in the chassis 11 and communicates with the groove suction holes 12 in the grooves 13. The groove suction duct 16 is also located between the groove suction holes 12 and a groove suction fan (first suction fan) 18 and connects them. The groove suction duct 16 supplies air suctioned from the groove suction holes 12 to the suction fan 18 and an air vent 20. The groove suction duct 16 communicates, via a groove suction shutter 21 that will be described later, with the groove suction fan 18 and an air vent 20 that opens to the atmosphere. The suction fan 18 is configured so that the suction fan 18 can suction air through the groove suction holes 12, via the groove suction duct 16, by driving and rotation of the suction fan 18. The suction fan 18 exhausts air suctioned through the groove suction holes 12 to outside of the printing apparatus 100 forcibly. An air duct (an outside air duct) 22 is located between the groove suction shutter 21 and the air vent 20. That is, the air vent 20 is located at a position where the air duct 22 that has branched from the groove suction duct 16 communicates with outside air. Further, a negative-pressure coupling duct 23 is located between the groove suction shutter 21 and the groove suction fan 18.

Rib suction holes (second suction portions) 14, through which outside air is to be suctioned, in the same manner as for the groove suction holes 12, to use suction to hold a print medium on the platen 10, are formed in support portions 15*a* of the ribs 15 that contact and support a print medium. In this embodiment, two rib suction holes 14 are formed in the support portion 15*a* of one rib 15. The individual rib suction holes 14 communicate with a rib suction fan (a second suction fan) 19 via a rib suction duct 17.

In addition to the grooves 13 formed between the ribs 15, margin-less printing grooves 29*a*, 29*b* and 29*c* are formed in the platen 10 and are employed to perform margin-less printing. The margin-less printing grooves 29*a*, 29*b* and 29*c* are formed at the location corresponding to the sizes of individual print media that are to be employed. When margin-less printing is performed, ink droplets that have been ejected for margin-less printing and have landed outside the print medium are collected outside the edges of the print medium. In this embodiment, the margin-less printing groove 29*a* is located at a position near the right end of the platen 10 in FIG. 3, and one of the edges of the print medium is aligned with the margin-less printing groove 29*a*. Further, the margin-less printing groove 29*b* or 29*c*, located at the position near the left end of the platen 10, is employed in accordance with the length of the print medium in the main scan direction X, i.e., the width of the print medium. When the length in the main scan direction X of a print medium in use corresponds to the length between the right end margin-less printing groove 29*a* and the left end margin-less printing groove 29*b* positioned near the center, the left end margin-less printing groove 29*b*, positioned near the center is employed. When the length in the main scan direction X of a print medium in use corresponds to the length between the right end margin-less printing grove 29*a* and the leftmost end margin-less printing groove 29*c*, the leftmost end margin-less printing groove 29*c* is employed. Referring to the example in FIG. 3, the length in the main scan direction X of a print medium corresponds to the length between the right end margin-less printing groove 29*a* and the leftmost end margin-less printing groove 29*c*.

The individual margin-less printing grooves 29*a*, 29*b* and 29*c* have recessed shapes, and serve as ink reservoirs where, during margin-less printing (borderless printing) performed over the edges of a print medium in the main scan direction X, ink applied in the oversized areas of the print medium is accepted. In this embodiment, to cope with two types of print media that differ in their lengths in the main scan direction X, either the margin-less printing groove 29*b* or 29*c* corresponding to the length of a print medium in the main scan direction X is employed. The margin-less printing groove 29*a* is employed in common for a print medium, regardless of whether the length in the main scan direction X differs. However, the present invention is not limited to this arrangement, and many more margin-less printing grooves may be formed to cope with three or more types of print media that differ in length in the main scan direction X. Furthermore, in this embodiment, one of the margin-less printing grooves is employed in common for multiple types of print media that differ in length in the man scan direction X; however, the present invention is also not limited to this arrangement. The margin-less printing grooves to be employed may differ for the right end and for the left end, depending on the lengths of the print media in the main scan direction X.

The margin-less printing grooves 29*a*, 29*b* and 29*c* communicate, respectively, with margin-less printing suction ducts 33. The margin-less printing suction ducts 33 are connected via a margin-less printing shutter 34 to the negative-pressure coupling duct 23.

Next, the groove suction shutter 21 (connection unit) will be described by referring schematic cross-sectional views presented in FIGS. 5A and 5B. The groove suction shutter 21 shown in FIG. 5A is in a state wherein the groove suction duct 16 communicates with the air duct 22, and the groove suction shutter 21 in FIG. 5B is in a state wherein the groove suction duct 16 communicates with the negative-pressure coupling duct 23.

In this embodiment, the groove suction shutter 21 is arranged at a junction of three air flow paths, i.e., the air duct 22, the groove suction duct 16 and the negative-pressure coupling duct 23. The air duct 22, the groove suction duct 16 and the negative-pressure coupling duct 23 are connected together to a negative-pressure chamber 24. A control valve 25 is arranged inside the negative-pressure chamber 24. The control valve 25 having a cylindrical shape is internally provided for the negative-pressure chamber 24 so that the control valve 25 is rotatable. In this embodiment, a motor, for example, is driven to rotate the control valve 25 inside the negative-pressure chamber 24 with the control valve 25 controlled. The control valve 25 includes an air flow path. That is, in this embodiment, an air control hole 26, a groove suction control hole 27 and a negative pressure hole 28 are formed in the control valve 25.

In this embodiment, the control valve 25 is configured so that when the control valve 25 is rotated inside the negative pressure chamber 24, the groove suction duct 16 communicates with the inside of the negative-pressure chamber 24, while maintaining communication between the groove suction duct 16 and the groove suction control hole 27. When rotation of the control valve 25 is moved inside the negative pressure chamber 24, the air control hole 26 and the negative pressure hole 28 are moved to control open or close of the air duct 22 and the negative-pressure coupling duct 23. In this embodiment, in accordance with the rotation of the control valve 25 inside the negative pressure chamber 24, a flow path that the groove suction duct 16 is to communicate with is selected and controlled, either the air duct 22 or the negative-pressure coupling duct 23. With the above described structure, the groove suction shutter 21 selectively connects the air duct 22 or the groove suction duct 16 to the groove suction hole 12.

In the state in FIG. 5A for the groove suction shutter 21, the negative-pressure coupling duct 23 is closed and the air duct 22 is open. Therefore, the groove suction duct 16 communicates with the air duct 22, and atmospheric pressure is maintained in the space enclosed by each groove 13 and a print medium. In the state shown in FIG. 5B for the groove suction shutter 21, the negative-pressure coupling duct 23 is open and the air duct 22 is closed. Therefore, when the groove suction duct 16 communicates with the negative-pressure coupling duct 23 and the groove suction fan 18 is driven and rotated, the groove suction fan 18 externally discharges the air in the groove suction duct 16 and in the space enclosed by the grooves 13 and a print medium. When the air is discharged from the groove suction duct 16 and from the space enclosed by the grooves 13 and the print medium, the pressure in the pertinent space is reduced to below the atmospheric pressure, and a negative pressure is obtained. Therefore, when a print medium is set on the platen 10, the print medium is suctioned and held on the platen 10 by applying the negative pressure.

In this embodiment, in the state in FIG. 5A wherein the groove suction duct 16 communicates with the air duct 22, in the flow path of the groove suction duct 16 and the air duct 22, an openings connected to the negative pressure chamber 24 are fully open. And in the flow path the negative-pressure coupling duct 23, the opening connected to the negative pressure chamber 24 is fully closed. In the case, shown in FIG. 5B, wherein the groove suction duct 16 communicates with the negative-pressure coupling duct 23 to suction air from the grooves 13, the control valve 25 is rotated until the opening of the air duct 22 connected to the negative pressure chamber 24 reaches the fully-close state. Further, in the flow path of the groove suction duct 16 and the negative-pressure coupling duct 23, the openings connected to the negative pressure chamber 24 are fully open. In this embodiment, a seal member, such as a packing seal, is arranged at the gap between the control valve 25 and the negative pressure chamber 24. Therefore, the groove suction shutter 21 is configured so that when a negative pressure is formed in the groove suction duct 16 by driving and rotation of the groove suction fan 18, a negative pressure leakage from a gap will not easily occur.

Figure 6A:
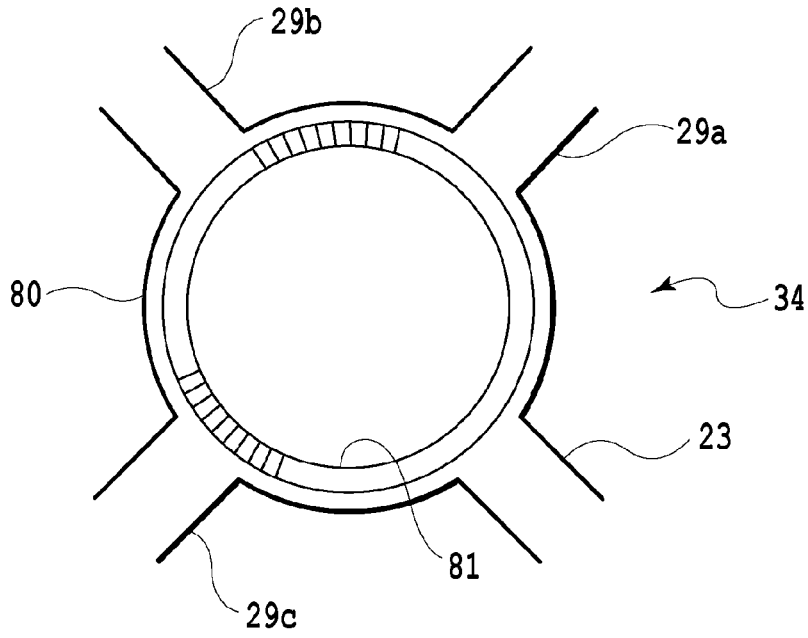
FIGS. 6A and 6B are enlarged, schematic cross-sectional views of the individual states for a margin-less printing shutter in FIG. 3.
Figure 6B:
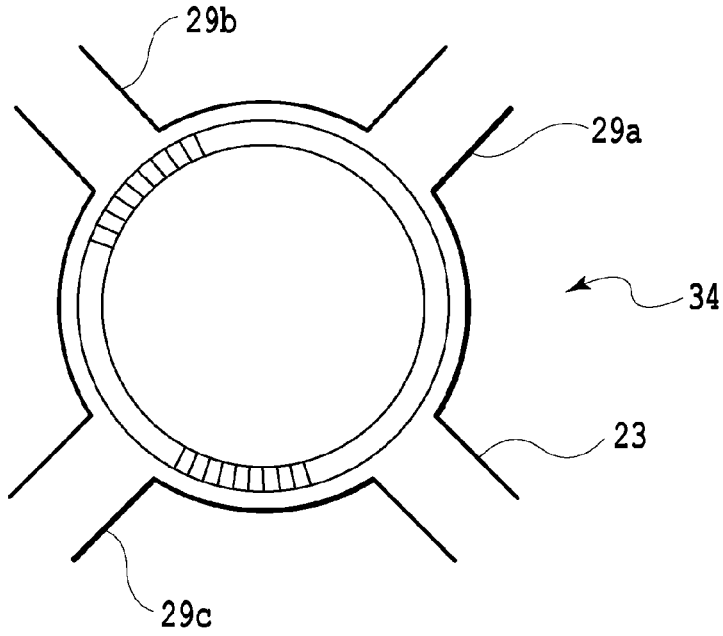

The margin-less printing shutter 34 will now be described. FIGS. 6A and 6B are schematic cross-sectional views of the margin-less printing shutters 34. For the margin-less printing shutter 34 as well as the groove suction shutter 21 described above, a control valve 81 is rotated in a negative pressure chamber 80 to control communication between the individual flow paths connected to the negative pressure chamber 80. In this embodiment, in accordance with the rotation of the control valve 81, communication of the margin-less printing grooves 29*a*, 29*b* and 29*c* with the negative-pressure coupling duct 23 is controlled.

Since the margin-less printing groove 29*a* is employed in common for different types of print media, a condition that the flow path for the margin-less printing groove 29*a* is communication with the flow path for the negative-pressure coupling duct 23 is kept. One of the margin-less printing grooves 29*b* and 29*c* is used corresponding to the length of a print medium in the main scan direction X. That is, either of the margin-less printing groove 29*b* or 29*c* is selected to communicate with the negative-pressure coupling duct 23. According to the state in FIG. 6A, the margin-less printing groove 29*b* communicates with the negative-pressure coupling duct 23, and the flow path for the margin-less printing groove 29*c* is closed. Therefore, since the margin-less printing grooves 29*a* and 29*b* communicate with the negative-pressure coupling duct 23, the groove suction fan 18 suctions air from the spaces inside the margin-less printing grooves 29*a* and 29*b*. As a result, in a case wherein margin-less printing is performed for a print medium, the length of which in the main scan direction X is equivalent to the length between the margin-less printing grooves 29*a* and 29*b*, ink applied over the paper edges to the margin-less printing grooves 29*a* and 29*b* can be suctioned via the margin-less printing grooves 29*a* and 29*b*.

In the state in FIG. 6B, the margin-less printing groove 29*c* communicates with the negative-pressure coupling duct 23, and the flow path for the margin-less printing groove 29*b* is closed. Therefore, since the margin-less printing grooves 29*a* and 29*c* communicate with the negative-pressure coupling duct 23, suction by the groove suction fan 18 is provided for the spaces in the margin-less printing grooves 29*a* and 29*c*. As a result, in a case wherein margin-less printing is performed for a print medium for which the length in the main scan direction X is equivalent to the length between the margin-less printing grooves 29*a* and 29*c*, ink applied over the paper edges into the margin-less printing grooves 29*a* and 29*c* can be suctioned via the margin-less printing grooves 29*a* and 29*c*. In this manner, the margin-less printing groove used to communicate with the negative-pressure coupling duct 23 is selected by rotating the control valve 81 of the margin-less printing shutter 34. With this arrangement, only a single suction fan, i.e., the groove suction fan 18, can perform both the suction to hold a print medium through the groove suction holes 12 and the discharging of waste ink from the individual margin-less printing grooves 29*a*, 29*b* and 29*c*.

Figure 7:
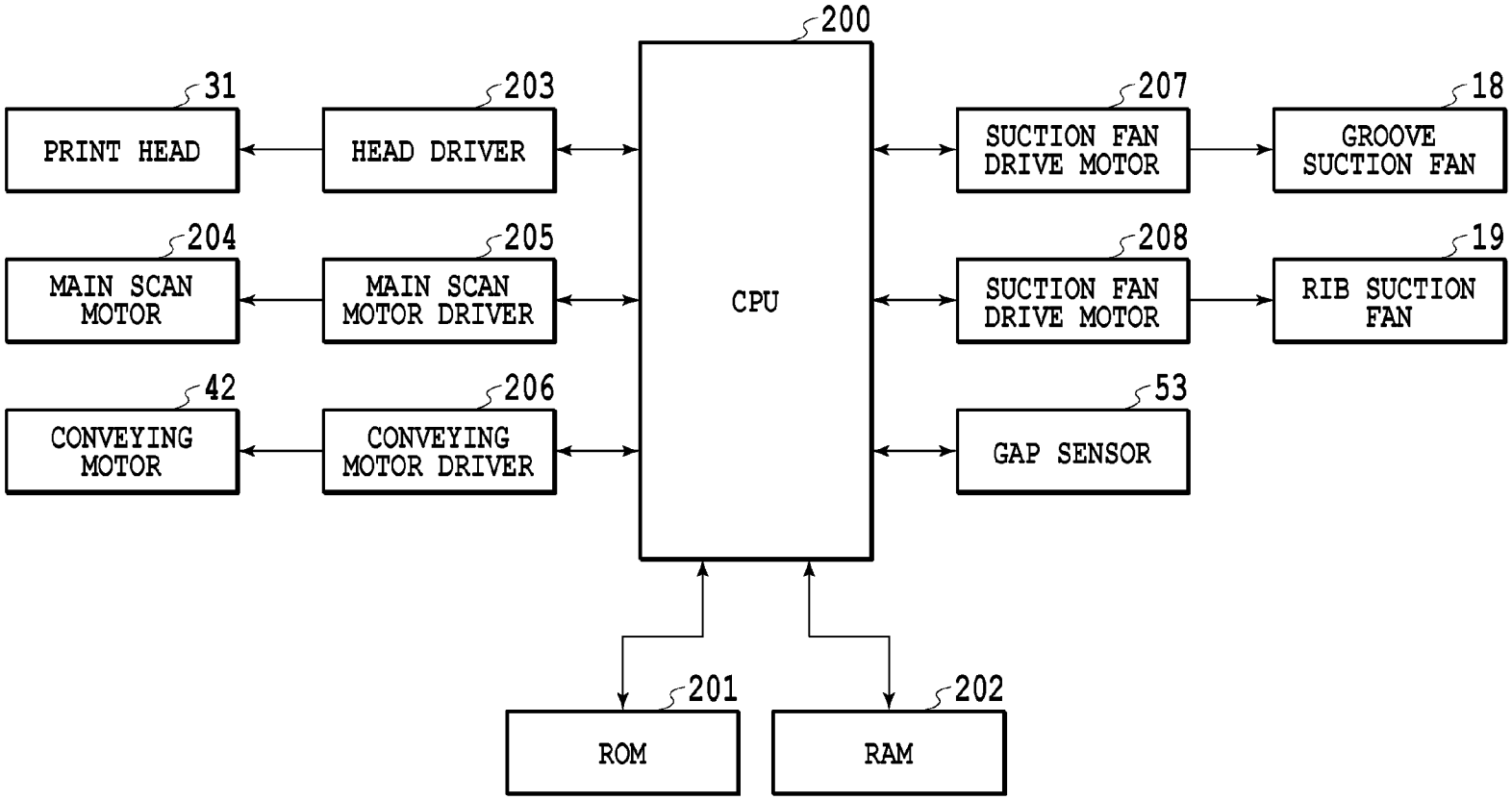
FIG. 7 is a schematic block diagram illustrating the arrangement of the control system of the printing apparatus in FIG. 1.

FIG. 7 is a schematic block diagram illustrating the arrangement of the control system of the ink jet printing apparatus 100 of this embodiment. In FIG. 7, the operations of the individual units of the printing apparatus 100 are controlled by a CPU 200 based on a control program stored in a ROM 201 and various data stored in a RAM 202. Specifically, a head driver 203, for driving print elements provided for the print head 31, a main scan motor driver 205, for driving a main scan motor 204, and a conveying motor driver 206, for driving the conveying motor 42, are connected to the CPU 200. Further, a suction fan drive motor 207, which is a drive source for driving the groove suction fan 18 is connected to the CPU 200. A suction fan drive motor 208, which is a drive source for the rib suction fan 19, is also connected to the CPU 200. The CPU 200 serves as a number of revolutions control unit that adjusts electric power that is to be supplied to the suction fan drive motors 207 and 208 to control the number of revolutions of the groove suction fan 18 and the rib suction fan 19. Furthermore, the printing apparatus 100 in this embodiment includes a gap sensor 53 that detects a distance between the face of the carriage 32 opposite the print medium and the printing face of the print medium. The gap sensor 53 is also connected to the CPU 200.

The printing apparatus 100 having the above described arrangement performs a suction process through a platen, in which a print medium is to be held in place on the platen 10 by suction. When a suction process is performed, the groove suction fan 18 and the rib suction fan 19 are rotated, a suction force is applied, via the suction holes formed in the platen 10, and a print medium is held in place on the platen 10. At this time, for a stiff and inflexible print medium (hereinafter also referred to as a print medium having high stiffness), it is preferable that a great suction force is applied in order to securely hold the print medium on the platen 10. Therefore, in this case, a suction force is applied via only the groove suction holes 12, or both the groove suction holes 12 and the rib suction holes 14, to hold the print medium on the platen 10.

Further, when printing is performed for a print medium that tends to curl, or a print medium employed for high-duty printing for which large-scale cockling tends to occurs, deformation of the print medium may occur in the support portions 15*a* of the platen 10. Here, print duty refers to the amount of ink used for a unit area of a print image. In a case wherein the print medium is deformed, a probability is that, depending on the degree of deformation, an image printed on the print medium will be smudged by contacting the print head 31, and the image quality degraded. In such a case, a suction pressure by using only the groove suction holes 12, or a suction pressure by using both of the groove suction holes 12 and the rib suction holes 14, is also applied to hold the print medium on the platen 10 in place, so that the deformed print medium does not contact the print head 31. As described above, since the groove suction holes 12 are employed to apply a suction pressure to a print medium through the platen 10 to hold the print medium on the platen 10 in place, when a print medium is deformed, the deformed portion is pulled inside the grooves 13 by a suction force applied via the groove suction holes 12. Therefore, the occurrence is prevented of a phenomenon such that the deformed portion of the print medium projects toward the print head 31 and contacts the print head 31, causing an image printed on the print medium to be smudged and the image quality to be degraded. Therefore, when printing is performed for a print medium having high stiffness, a print medium that tends to curl, or a print medium employed for high-duty printing, simply the groove suction holes 12 are employed, or both the groove suction holes 12 and the rib suction holes 14, are employed to apply a suction pressure.

At this time, the groove suction shutter 21 selects a flow path that communicates with the groove suction fan 18, so that a suction pressure is to be applied by using the groove suction holes 12, or both the groove suction holes 12 and the rib suction holes 14. In this case, the control valve 25 that is internally provided for the groove suction shutter 21 is rotated, so that the groove suction duct 16 communicates with the negative-pressure coupling duct 23 connected to the groove suction fan 18. Further, when the rib suction holes 14 are also employed for suction, the rib suction fan 19 is driven and rotates, and a suction force is passed, via the rib suction duct 17 connected to the rib suction fan 19, and applied through the rib suction holes 14, which are openings in the rib suction duct 17.

The groove suction shutter 21 is adjusted in the above described manner. Also, the margin-less printing shutter 34 is controlled to select the margin-less printing grooves 29*a*, 29*b* and 29*c*, through which a suction force is to be applied for margin-less printing. With this adjustment process, smudging of the reverse side of print medium by an ink mist can be prevented during printing.

When low-duty printing that only a small amount of ink for a unit area is used, such as line art printing, is performed on a print medium having a comparatively low strength and a low bending resistance (hereinafter also called a print medium with low stiffness), a suction force is applied only via the rib suction holes 14. At this time, the groove suction holes 12 are not employed, and suction from the rib suction holes 14 are performed. In this case, to prevent the application of a suction force via the groove suction holes 12, the groove suction shutter 21 adjusts the position of the control valve 25, so that the groove suction duct 16, extended from the groove suction holes 12, communicates with the air duct 22 connected to the air vent 20. Further, the rib suction fan 19 is driven and rotated to apply suction via the rib suction holes 14, which are formed in the support portions 15*a* of the platen 10. As described above, when low-duty printing is performed on a print medium having low stiffness, only the rib suction holes 14 are employed to provide suction for the print medium, and the groove suction holes 12 are not employed. Therefore, when a print medium is held on the platen 10 by suction, the pulling of portions of the print medium between the ribs, though cockling does not occur, can be avoided. Thus, the wavy condition of the print medium, which is caused by pulling a part of the print medium into the grooves between the ribs, is prevented, the distance between the print medium and the print head is maintained, and the accuracy with which ink droplets land on the print medium is stable. Therefore, unevenness in the printing of images, which is the result of a deviation in the landing positions of ink droplets, is suppressed, and the printing of high quality images can be maintained.

In this embodiment, when a print medium having a comparatively high stiffness is employed, or when high-duty printing is performed, only the groove suction holes 12, or both the groove suction holes 12 and the rib suction holes 14, are employed to apply a suction force. However, when a print medium having a comparatively low stiffness is employed, even though comparatively high-duty printing is performed, there is a probability that when a suction force is applied through the groove suction holes 12, the print medium will enter the grooves. Therefore, in this embodiment, even when print duty is comparatively high, the suction pressure applied via the groove suction holes 12 is adjusted in accordance with the stiffness of the print medium. Suction is controlled so that a low suction force is set from the groove suction holes 12 with respect to a print medium having a low stiffness. That is, the ratio of the amount of suction applied via the groove suction holes 12 with respect to the amount of suction applied via the rib suction holes 14 is adjusted, so that the ratio is reduced for a print medium having little strength. Therefore, when high-duty printing is performed on a print medium having a comparatively low stiffness, suction is performed by using both the groove suction holes 12 and the rib suction holes 14, with the condition that a low suction force is set for the groove suction holes 12. Since suction is performed in this manner for high-duty printing on a print medium having a comparatively low stiffness, cockling of the print medium, which causes the print medium to be deformed toward the print head, is avoided, while the entry of the print medium into the grooves 13 can be suppressed. Furthermore, since the scale of cockling might be increased for high-duty printing, a comparatively large amount of suction is set for the suction holes 12. As a result, even when cockling of the print medium has occurred, the extending of the deformed portion of the print medium to the print head 31 can be suppressed. In contrast, for low-duty image printing, there is a probability that the print medium will be drawn into the grooves 13, even though cockling is unlikely to occur, and a comparatively small amount of suction is set for the groove suction holes 12. That is, the ratio of the amount of suction performed via the groove suction holes 12, with respect to the amount of suction performed via the rib suction holes 14 is controlled, so that the ratio is reduced when the print duty becomes low. Therefore, since the drawing into the groves 13 of a print medium is prevented, the surface of the print medium does not become wavy, and the distance between the print medium and the print head 31 is maintained, so that the degrading of the quality of a printed image can be suppressed.

When margin-less printing is performed, the control valve 81 of the margin-less printing shutter 34 is adjusted, and suction is performed via the groove suction holes 12 formed in the margin-less printing grooves 29*a* to 29*c*, which are selected in corresponding to the length of a print medium in the main scan direction X. Therefore, when margin-less printing is performed, ink applied over the edges of the print medium can be collected by suction. In this embodiment, suction for collecting ink is performed via the margin-less printing grooves 29*a* and 29*c*. At this time, the groove suction fan 18 is driven and rotated, and also, the position of the control valve 81 of the margin-less printing shutter 34 is adjusted so that the negative-pressure coupling duct 23 communicates with the margin-less printing grooves 29*a* and 29*c*.

In this embodiment, the margin-less printing shutter 34 is employed to select the margin-less printing grooves 29*a* to 29*c* to use for performing suction. However, when suction based on the margin-less printing grooves 29*a* to 29*c* is performed, all of the margin-less printing grooves 29*a*, 29*b* and 29*c* provided for the platen 10 may be employed. In this case, the margin-less printing groove 29*b* located inside the two edges of the print medium is not actually employed for the suction of ink. However, since all of the margin-less printing grooves 29*a* to 29*c* of the platen 10 are employed to perform suction, accordingly, a suction is performed from the margin-less printing groove 29*b*. In case that the printing is performed on a low-stiffness print medium, there is a possibility that when a suction is performed from the margin-less printing groove 29*b* located inside the two edges of the print medium, part of the print medium is drawn into the margin-less printing groove 29*b*. Then, there is a probability that the print medium will become wavy, that the distance between the printing face of the print medium and the print head will not be maintained, that there will be a deviation in the landing positions of ink droplets, and that the uneven printing of images will occur. In order to cope with such eventualities, a coupling rib 35 is formed between the margin-less printing groove 29*b* and part of a groove 13*a*, which is adjacent to the margin-less printing groove 29*b*, so that the margin-less printing groove 29*b* communicates with part of the groove 13*a*. When low-duty printing is performed for a low-stiffness print medium, for which cockling is unlikely to occur, suction using the groove suction holes 12 is not performed. Therefore, the groove suction shutter 21 is controlled, so that the groove suction duct 16, extended from the groove suction holes 12, communicates with the air duct 22 connected to the air vent 20. Thus, the atmospheric pressure is maintained inside the groove 13*a*. Since the margin-less printing groove 29*b* and the groove 13*a* communicate with each other, the pressure inside the margin-less printing groove 29*b* is also maintained at the atmospheric pressure level. As a result, when low-duty printing is performed for a low-stiffness print medium, the drawing of part of the print medium into the margin-less printing groove 29*b* can be suppressed, and for the print medium, a wavy condition can be avoided.

The manner in which to perform suction, i.e., suction for which both the rib suction holes 14 and the groove suction holes 12 are used, suction for which only the groove suction holes 12 or only the rib suction holes 14 are used, may be selected by the printing apparatus based on a printing mode and the type of print medium identified by the printing apparatus 100. Further, the manner in which suction is performed may also be selected by a user. As for identification of the type of print medium, either the printing apparatus 100 may detect the print medium type. Further, a user may input the print medium type to the printing apparatus 100.

In this embodiment, the groove suction fan 18, for applying a suction pressure via the groove suction holes 12, and the rib suction fan 19, for applying a suction pressure via the rib suction holes 14 are provided separately. Therefore, the amount of suction from the groove suction holes 12 and the amount of suction from the rib suction holes 14 is individually controlled. In this embodiment, the CPU 200 serves as a control unit for individually controlling the amount of suction from the groove suction holes 12 and the amount of suction from the rib suction holes 14.

Figure 8A:
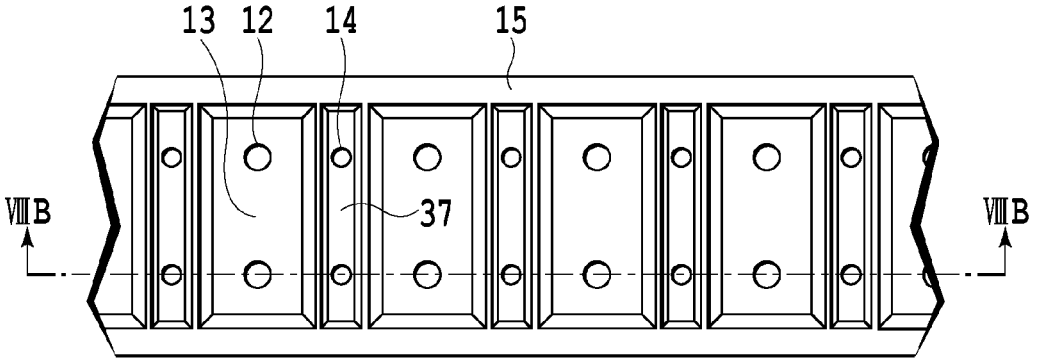
FIG. 8A is a schematic plan view of another embodiment periphery for the platen of the printing apparatus in FIG. 1.
Figure 8B:
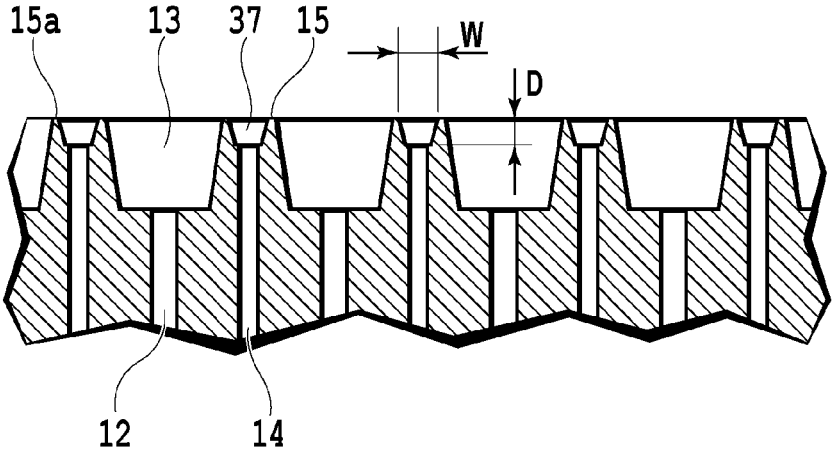
FIG. 8B is an enlarged, schematic cross-sectional view of the essential portion of the platen in FIG. 8A.

In this embodiment, the support portions 15*a* of the ribs 15 that contact and support the print medium are formed flat; however, the present invention is not limited to this shape. As shown in FIGS. 8A and 8B, a slit 37 may be formed in each of the support portions 15*a* of the ribs 15 in order to efficiently hold the print medium on the platen 10 using suction. FIG. 8A is a plan view of the support portions 15*a* of the ribs 15 that contact and support the print medium, and FIG. 8B is a cross-sectional view taken along a line VIIIB-VIIIB in FIG. 8A. According to the example structure shown in FIGS. 8A and 8B, since suction force is applied through all the open areas in the slits 37, the print medium can be held in place on the platen 10. Therefore, a comparatively large area of a print medium can be employed to apply a suction force, and the print medium can be efficiently held. As a preferable shape for the slits 37, for example, a width W is smaller than the width of the support portion 15*a* of the rib 15, and a depth D is equal to or greater than the width of the slit 37. When the slits 37 are formed in this shape, suction can be more efficiently performed for the print medium.

Second Embodiment

A printing apparatus according to a second embodiment of the present invention will now be described. It should be noted that descriptions will not be given for portions corresponding to those in the first embodiment by providing the same reference numerals, and that descriptions will be given only for different portions.

Figure 9:
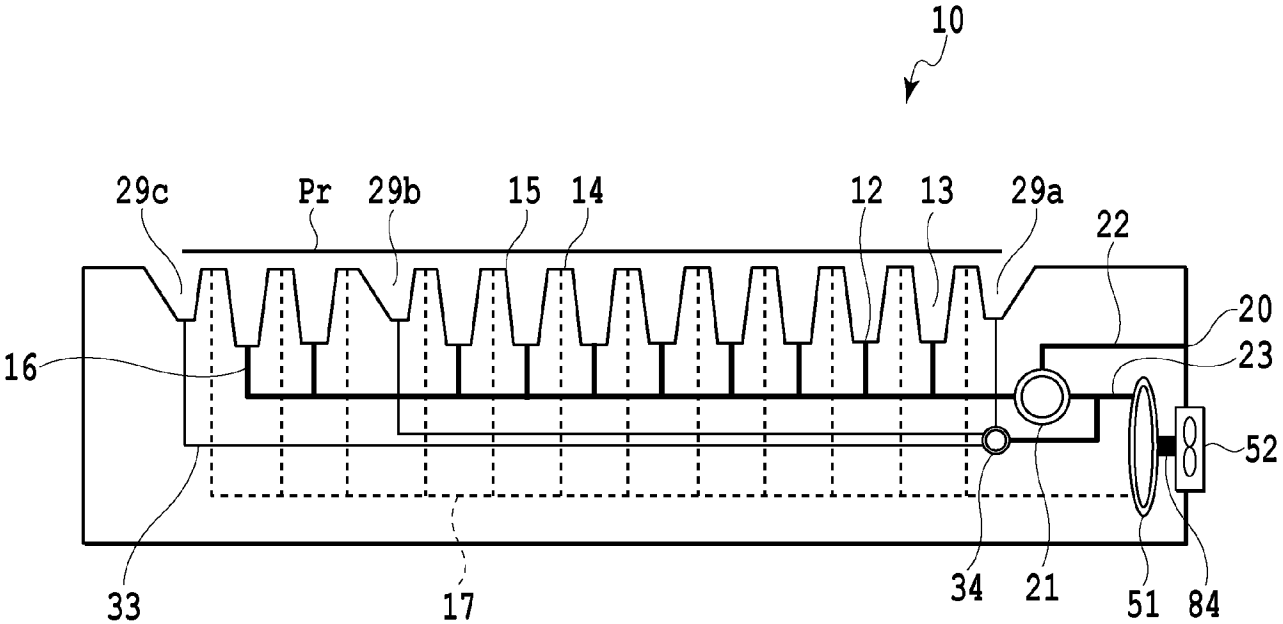
FIG. 9 is a schematic cross-sectional view of the essential portion of a printing apparatus according to a second embodiment of the present invention.
Figure 10A:
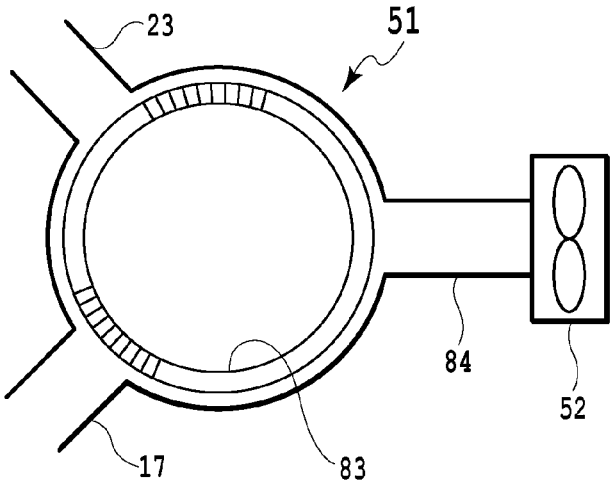
FIGS. 10A, 10B and 10C are enlarged, schematic cross-sectional views of the individual states of a duct shutter for the printing apparatus in FIG. 9.
Figure 10B:
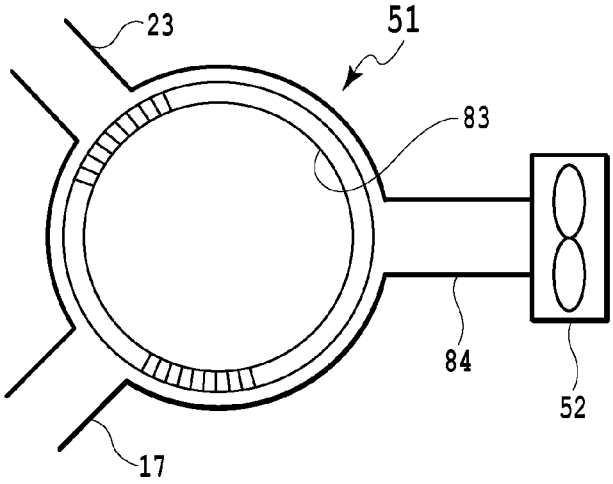
Figure 10C:
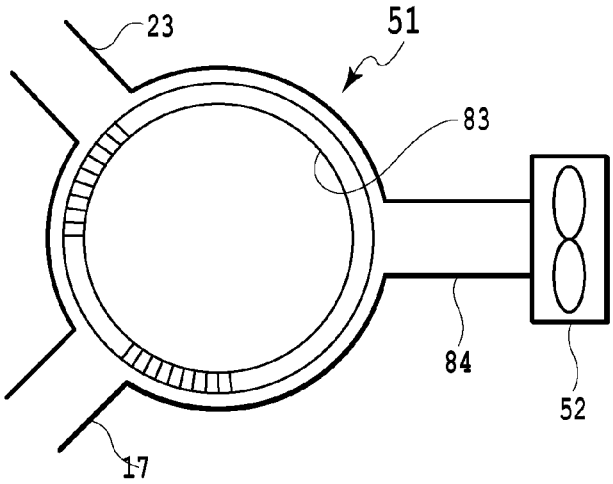

FIG. 9 is a schematic cross-sectional view of the periphery of the platen of the printing apparatus in the second embodiment. In the second embodiment, a groove suction duct 16 and a rib suction duct 17 are connected together, and a duct shutter (duct switching mechanism) 51 is arranged at the joint of the two ducts. Further, single common use suction fan (a third suction fan) 52 is located upstream of the duct shutter 51 and is employed as means for generating a negative pressure via the individual suction holes. FIGS. 10A to 10C are enlarged cross-sectional views of the duct shutter 51.

Similar to the groove suction shutter 21 in the first embodiment, when a control valve 83 is rotated inside a negative-pressure chamber 82, the duct shutter (the second flow path switching valve) 51 can change communication of flow paths connected to the negative-pressure chamber 82. In this embodiment, a flow path 84 connected to the common use suction fan 52, the rib suction duct 17 connected to rib suction holes 14, and a negative-pressure coupling duct 23 connected to a groove suction shutter 21 and a margin-less printing shutter 34 are all connected to the negative-pressure chamber 82 of the duct shutter 51. Regardless of how the control valve 83 is rotated, the flow path 84 connected to the common use suction fan 52 is maintained closed. Further, in accordance with the rotation of the control valve 83, the flow paths of the rib suction duct 17 and the negative-pressure coupling duct 23 are switched between open and closed.

FIG. 10A is a schematic cross-sectional view of the duct shutter 51 in the state wherein the negative-pressure coupling duct 23 is open and the rib suction duct 17 is closed. In this state, the common use suction fan 52 communicates with the negative-pressure coupling duct 23, and when the common use suction fan 52 is driven, a suction force is transmitted to the negative-pressure coupling duct 23 and a groove suction shutter 21. The groove suction shutter 21 is provided so that the groove suction duct 16, extended to the groove suction holes 12, communicates either with the negative-pressure coupling duct 23 or an air duct 22 connected to an air vent 20. Therefore, when the groove suction shutter 21 is operated so that the groove suction duct 16 is connected to the negative-pressure coupling duct 23, a suction force transmitted by the common use suction fan 52 reaches the groove suction holes 12 via the groove suction duct 16. Thus, a suction force transmitted by the common use suction fan 52 is applied via the groove suction holes 12 to perform suction. Further, even in the state wherein the common use suction fan 52 communicates with the negative-pressure coupling duct 23, when the groove suction shutter 21 is operated so that the groove suction duct 16 communicates with the air duct 22, a suction force transmitted by the common use suction fan 52 does not reach the groove suction holes 12. Therefore, at this time, a suction force transmitted by the common use suction fan 52 is not applied via the groove suction holes 12.

Since the negative-pressure coupling duct 23 is also connected to the margin-less printing shutter 34, when margin-less printing grooves to be employed are selected, the suction of ink is also enabled by driving the common use suction fan 52 from the margin-less printing grooves.

FIG. 10B is a schematic cross-sectional view of the duct shutter 51 in the state wherein the negative-pressure coupling duct 23 is closed and the rib suction duct 17 is open. In this state, the common use suction fan 52 is communicating with the rib suction duct 17, and when the common use suction fan 52 is driven, a suction force is applied via the individual rib suction holes 14.

FIG. 10C is a schematic cross-sectional view of the duct shutter 51 in the state wherein both the negative-pressure coupling duct 23 and the rib suction duct 17 are partially open. As shown in FIG. 10C, when the control valve 83 is positioned at a location between that shown in FIG. 10A and that shown in FIG. 10B, the duct shutter 51 can partially open both the negative-pressure coupling duct 23 and the rib suction duct 17. As a result, the common use suction fan 52 can communicate with both the negative-pressure coupling duct 23 and the rib suction duct 17. Then, when the groove suction shutter 21 is employed to establish communication between the groove suction duct 16 and the negative-pressure coupling duct 23, suction via the rib suction holes 14 and suction via the groove suction holes 12 can be performed at the same time. At this time, the position of the control valve 83 is adjusted for a ratio of the amount of suction, that is provided inside a flow path 84 connected to the common use suction fan 52 and divided, between suction to be transmitted to the negative-pressure coupling duct 23 and suction to be transmitted to the rib suction duct 17 is controlled. That is, the suction ratio between the negative-pressure coupling duct 23 and the rib suction duct 17 can be controlled by adjusting the control valve 83. As a result, the ratio of the amount of suction employed for the rib suction holes 14 relative to the amount of suction employed for the groove suction holes 12 can be determined. As described above, the duct shutter 51 is connected to the groove suction duct 16 and the rib suction duct 17, and can change the ratio of the amount of air to be suctioned from the groove suction holes 12, with respect to the amount of air to be suctioned from the rib suction holes 14.

Furthermore, since the suction force exerted by the common use suction fan 52 is separately distributed to the groove suction duct 16 and the rib suction duct 17 by the duct shutter 51, the total amount of air to be suctioned from the groove suction holes 12 and the rib suction holes 14 should be constant. Therefore, the amount of suction using the groove suction holes 12 and the amount of suction using the rib suction holes 14 are controlled in correlation with each other to obtain the constant total of the amounts of suction using the groove suction holes 12 and the amount of suction using the rib suction holes 14. At this time, the CPU 200 serves as a control unit for controlling, in correlation with both, the amount of suction using the groove suction holes 12 and the amount of suction using the rib suction holes 14.

According to the printing apparatus of the second embodiment, only one fan is required to generate a negative pressure for performing suction via the rib suction holes 14, for performing suction via the groove suction holes 12 and for performing suction via margin-less printing grooves 29*a*, 29*b* and 29*c*. Since the number of fans can be reduced, the noise level can also be reduced. Moreover, since a vibration level can also be lowered, degrading of the quality of a printed image can be suppressed. Furthermore, since the arrangement of the printing apparatus can be simplified, the size of the apparatus and the manufacturing cost for the printing apparatus can be reduced.

Third Embodiment

A printing apparatus according to a third embodiment of the present invention will now be described. It should be noted that descriptions will not be given for portions corresponding to those in the first embodiment by providing the same reference numbers, and that descriptions will be given only for different portions.

Figure 11:
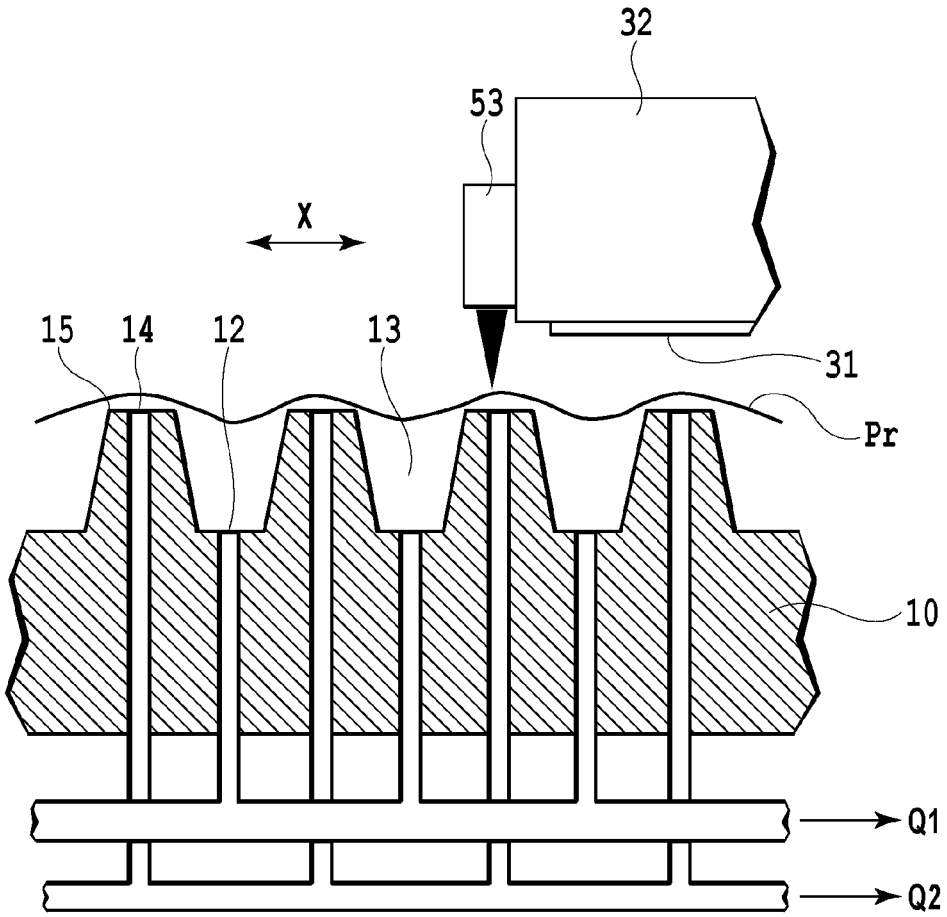
FIG. 11 is a schematic cross-sectional view of a print head and the periphery of a platen for a printing apparatus according to a third embodiment of the present invention.

FIG. 11 is an enlarged, schematic cross-sectional view of the periphery of a print head 31 and a platen 10 for the printing apparatus of the third embodiment. In the third embodiment, suction is performed using both rib suction holes 14 and groove suction holes 12 to hold a print medium on the platen 10. Further, a ratio of the amount of air to be suctioned from the groove suction holes 12 and the amount of air to be suctioned from the rib suction holes 14 can be changed. For the printing apparatus of the third embodiment, a gap sensor (distance detection unit) 53 is mounted on a carriage 32. A distances between a print head 31 and the printing face of a print medium can be detected by the gap sensor 53. Since the gap sensor 53 is mounted on the carriage 32, when the carriage 32 moves in the main scan direction X, the gap sensor 53 can be moved with the carriage 32 in the main scan direction X. Hence, the gap sensor 53 performs continuous detection of distances between the print medium and the print head 31, with the carriage 32 scanning along the main scan direction X. Thus, a distribution of distances between the print medium and the print head 31 can be detected along the main scan direction X over the entire area of the print medium. Moreover, suction to be performed using the rib suction holes 14 and the groove suction holes 12 is adjusted with the distances between the print medium and the print head 31 over the entire area of the print medium detected. Thus, suction pressures to be applied via the rib suction holes 14 and the groove suction holes 12 corresponding to individual types of print media are determined. The appropriate suction pressures for the rib suction holes 14 and the groove suction holes 12 that are determined for an employed print medium are defined as Q1 and Q2, respectively.

Figure 12:
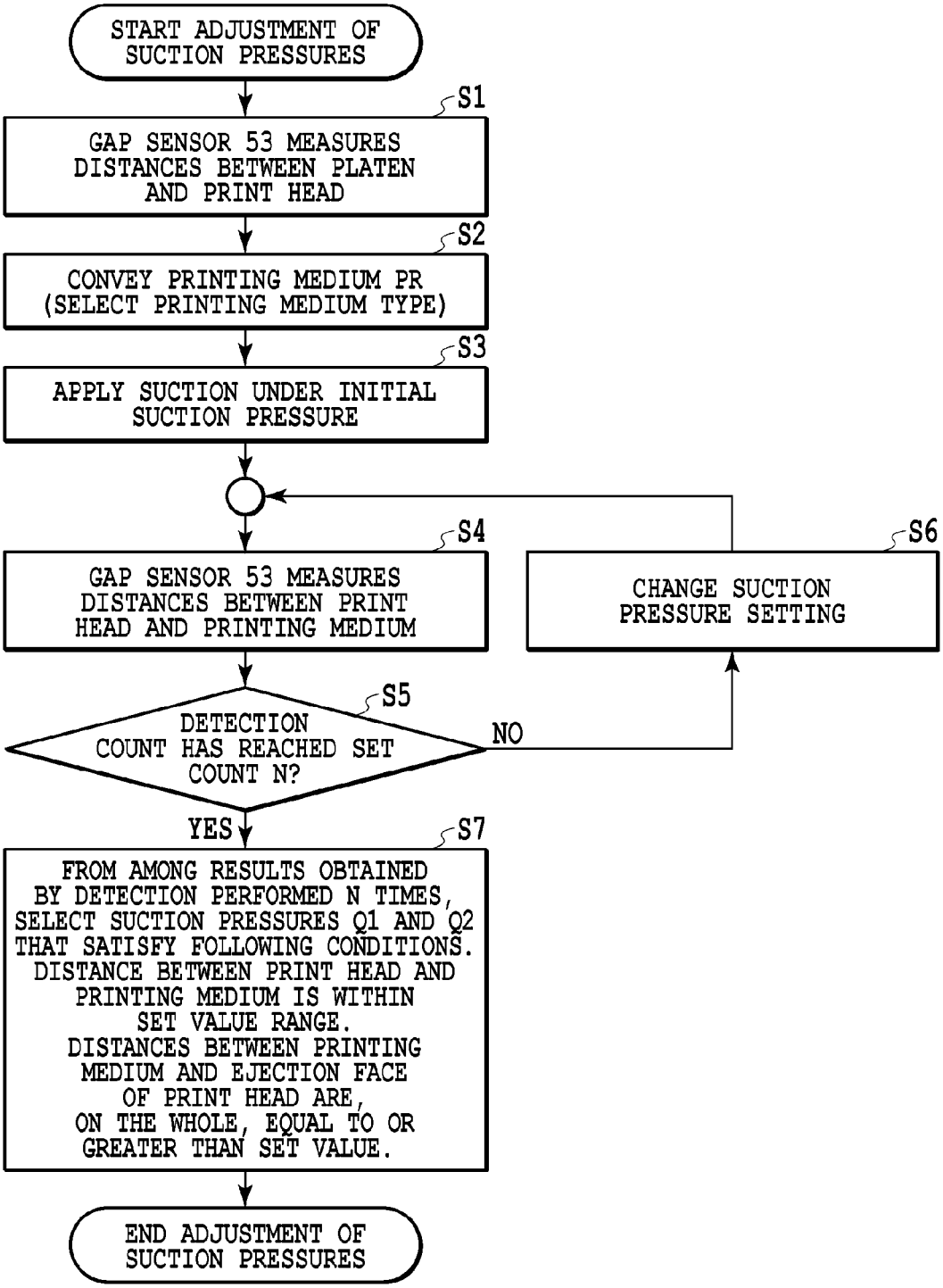
FIG. 12 is a flowchart showing the suction processing performed by the printing apparatus in FIG. 11.

The suction processing performed by the printing apparatus of the third embodiment using the rib suction holes 14 and the groove suction holes 12 corresponding to individual types of a print medium will now be described. FIG. 12 is a flowchart showing the processing for appropriately adjusting the suction pressures to be applied via the rib suction holes 14 and the groove suction holes 12 corresponding to a print medium type.

First, when a print medium has not yet been set on the platen 10, the carriage 32 is moved in the main scan direction X, and the gap sensor 53 mounted on the carriage 32 measures the distance between the carriage 32 and the upper face of the platen 10 for the overall area, in the main scan direction X (S1). Thereafter, a print medium is conveyed to the platen 10 (S2). At this time, a print medium type is input into the printing apparatus. With respect to input the type of print medium, a user may input a print medium type, or the printing apparatus may detect the print medium type. Following this, the print medium is suctioned and held on the platen 10 by applying an initially designated suction pressure (S3). At this time, an appropriate suction pressure may be selected based on the type of print medium that has been input. Then, the gap sensor 53 measures distances between the printing face of the print medium and the print head 31 (S4). During this process, the carriage 32 scans the entire area of the print medium in the main scan direction X to obtain, for the overall area, in the main scan direction X, a distribution of distances between the printing face of the print medium and the print head 31. Further, since the distribution of the distances between the printing face of the print medium and the print head 31 is obtained for the entire area in the main scan direction X, a fluctuation in the distance between the printing face of the print medium and the print head 31 is detected for each measurement.

The gap sensor 53 repeats, n times, the measurement of the distances between the printing face of the print medium and the print head 31 with changing conditions. In this embodiment, the amount of air suctioned from the groove suction holes 12 and the amount of air suctioned from the rib suction holes 14 are changed to perform suction and hold the print medium multiple times, and printing is performed. Each time the gap sensor 53 has measured the distance between the printing face of the print medium and the print head 31, a judgment is performed whether number of a measurement of a distance counted has reached a count n that is set in advance as a threshold value (S5). When number of measurement of a distance has reached n, the processing control advances to step S7. When number of measurement is smaller than n, the suction pressure applied via the rib suction holes 14 and the suction pressure applied via the groove suction holes 12 are changed (S6), and a distance between the printing face of the print medium and the print head 31 is measured again (S4). Based on the results obtained by performing the distance measurement n times, a suction pressure applied via the rib suction holes 14 and a suction pressure applied via the groove suction holes 12 are read that satisfy the condition wherein a comparatively large distance is maintained between the printing face of the print medium and the print head 31, and fluctuation in the distance is small for the overall area. Specifically, the amount of air suctioned from the rib suction holes 14 and the amount of air suctioned from the groove suction holes 12 are read that satisfy the condition wherein a distance between the print medium and the print head 31 is, as a whole, equal to or greater than a value that is set in advance, and the entire fluctuation for the distances falls in a range between predesignated values. In other words, the amount of suction from the rib suction holes 14 and the amount of suction from the groove suction holes 12 are read that satisfy the condition wherein the distance detected by the gap sensor 53 is within a predetermined range. The suction pressures, which is read, that correspond respectively to the amount of suction from the rib suction holes 14 and the amount of suction from the groove suction holes 12 are set as optimal suction pressures Q1 and Q2 (S7). As described above, a suction ratio is determined for one of a plurality of suction performances, wherein a distance between the print head 31 and the print medium is greater than a distance threshold value that is set in advance, and a fluctuation in the distance is smaller than a threshold value that is set in advance for distance fluctuation. The amount of air suctioned from the groove suction holes 12 and the amount of air suctioned from the rib suction holes 14 are set for the printing apparatus.

As described above, suction and hold of the print medium in place to support portions 15*a* is repeated by changing the amount of suction from the groove suction holes 12 and the amount of suction from the rib suction holes 14. The amount of suction using the groove suction holes 12 and the amount of suction using the rib suction holes 14, with which the distance detected by the gap sensor 53 falls within a predetermined range, are set as values to be employed for printing an image on the print medium. Further, the amount of suction from the groove suction holes 12 and the amount of suction from the rib suction holes 14 are thereafter employed to suction and hold the print medium on the platen 10. Therefore, the amount of suction from the groove suction holes 12 and the amount of suction from the rib suction holes 14 are controlled, so that the print medium avoids contact with the print head 31, and the surface fluctuation of the print medium in a direction opposed to the print head 31 is within a predetermined range. In this embodiment, a CPU 200 serves as a control unit for controlling the amount of suction from the groove suction holes 12 and the amount of suction from the rib suction holes 14. The CPU 200 also serves as a suction amount setting unit for setting the amount of suction from the groove suction holes 12 and the amount of suction from the rib suction holes 14 employed for printing an image on the print medium.

According to the printing apparatus of this embodiment, the optimal suction pressures applied via the rib suction holes 14 and the groove suction holes 12 can be set in accordance with the type of print medium and the operating environment. Since the suction pressures thus designated are applied via the rib suction holes 14 and the groove suction holes 12 to perform suction, a fluctuation in the distance between the printing face of the print medium and the print head can be reduced during printing. Therefore, deviations in the landing positions of ink, which are caused by the distance between the print head and the printing face of the print medium fluctuating greatly, can be suppressed. As a result, the production of high quality printed images can be maintained.

Other Embodiment

In the above described embodiments, an ink jet printing apparatus that employs paper winded to have a roll-like shape (rolled paper) as a print medium has been described as an example. However, the present invention can also be applied for an ink jet printing apparatus that employs, as print media, other print medium types, such as shapes and sizes, like cut-sheet paper prepared in standard sizes. Also in the above described embodiments, a serial scan type ink jet printing apparatus has been employed, wherein printing is performed by a print head mounted on a carriage that moves along a print medium. However, the present invention is not limited to this type, and may also be applied for a line-type ink jet printing apparatus that, to perform printing, conveys a print medium in a sub-scan direction and does not move a print head in the main scan direction. The present invention may also be applied for another printing type of ink jet printing apparatus. Furthermore, so long as an apparatus is an ink jet printing apparatus, the present invention can be applied, regardless of the number of print heads, the number of colors and types of ink, and the properties of the ink to be used and of the material of a print medium, such as paper or plastic sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-142930, filed Jun. 28, 2011, which is hereby incorporated by reference herein in its entirety.

What is claimed is:

1. A printing apparatus, which includes a print head capable of ejecting ink, and which ejects ink from the print head onto a print medium conveyed along a support face of a platen, on which the print medium is supported, comprising:

grooves, formed in the support face of the platen for supporting the print medium and extended in a conveying direction in which the print medium is conveyed;

first suction portions, formed inside the grooves to perform suction;

a first suction unit for suctioning air from the first suction portions;

second suction portions formed in the support face of the platen;

a second suction unit for suctioning air from the second suction portions; and a control unit being able to control a ratio of an amount of suction provided by the first suction unit and an amount of suction provided by the second suction unit, based on at least either a stiffness of a print medium or a print duty.

2. The printing apparatus according to claim 1, wherein when the stiffness of the print medium is lower, the control unit reduces the ratio of the amount of suction provided by the first suction unit, with respect to the amount of suction provided by the second suction unit.

3. The printing apparatus according to claim 1, wherein when the print duty is lower, the control unit reduces the ratio of the amount of suction provided by the first suction unit, with respect to the amount of suction provided by the second suction unit.

4. The printing apparatus according to claim 1, wherein the first suction unit includes a first suction fan for suctioning air from the first suction portions; and wherein the second suction unit includes a second suction fan for suctioning air from the second suction portions.

5. The printing apparatus according to claim 4, wherein the first suction unit includes:

an air duct with which to communicate with outside air;

a suction duct connected to the first suction fan; and a connection unit for selectively connecting the air duct or the suction duct to the first suction portions.

6. The printing apparatus according to claim 4, wherein the first and second suction units include a third suction fan, used in common, that is capable of suctioning outside air in through the first and second suction portions.

7. The printing apparatus according to claim 1, wherein the control unit separately controls the amount of suction provided by the first suction unit and the amount of suction provided by the second suction unit.

8. The printing apparatus according to claim 1, wherein the control unit controls the amount of suction provided by the first suction unit and the amount of suction provided by the second suction unit in correlation with each other, so that a constant value is maintained as a total of the amount of suction provided by the first suction unit and the amount of suction provided by the second suction unit.

9. The printing apparatus according to claim 1, wherein the control unit controls the suction amounts provided by the first and second suction units, so that the print medium avoids contact with the print head, and surface fluctuation of the print medium, relative to the print head, falls within a predetermined range.

10. The printing apparatus according to claim 1, further comprising:

a distance detection unit for detecting a distance between the print head and a print medium; and a suction amount setting unit for setting suction amounts to be provided by the first and second suction units that satisfy conditions in a case that a distance detected by the distance detection unit falls within a predetermined range when suctioning and holding a print medium on the support face has been performed a plurality of times by changing the suction amounts provided by the first and second suction units, and the suction amounts being set as the suction amounts, to be provided by the first and second suction units, controlled by the control unit when printing an image on the print medium is performed.

11. A printing apparatus comprising:

a print head for ejecting ink;

a platen having a support face in which grooves are formed and on which a print medium is supported;

suction portions formed in the grooves; and a control unit for controlling a suction force, applied through the suction portions, changing corresponding to at least one of a stiffness of the print medium and an amount of ink to be applied.

12. The printing apparatus according to claim 11, wherein when the stiffness of the print medium is lower, the control unit reduces the suction force applied via the suction portions.

13. The printing apparatus according to claim 11, wherein when the amount of ink applied is smaller, the control unit reduces the suction force applied via the suction portions.

* * * * *